United States Patent [19]

Harper

[11] Patent Number: 4,607,840

[45] Date of Patent: Aug. 26, 1986

[54] WEIGHT TRAINING DEVICE

[76] Inventor: James J. Harper, Rte. 1, Box 21-D, Newman Lake, Wash. 99025

[21] Appl. No.: 565,332

[22] Filed: Dec. 27, 1983

[51] Int. Cl.[4] ..... A63B 21/00

[52] U.S. Cl. ..... 272/117; 272/143; 272/122

[58] Field of Search ..... 272/122, 123, 143, 93, 272/117, 119

[56] References Cited

U.S. PATENT DOCUMENTS

| | | | |
|---|---|---|---|
| 734,062 | 7/1903 | Harris | 272/122 |
| 1,658,108 | 2/1928 | Vaughn . | |
| 2,617,650 | 11/1952 | Landis | 272/122 |
| 4,231,569 | 11/1980 | Rae | 272/122 |
| 4,312,506 | 1/1982 | Brennan | 272/122 X |
| 4,327,908 | 5/1982 | James | 272/122 X |

*Primary Examiner*—Richard J. Apley
*Assistant Examiner*—William R. Browne
*Attorney, Agent, or Firm*—Wells, St. John & Roberts

[57] ABSTRACT

A device for mounting weight training plates at an extended distance beyond the hand of the user applies selective leverage against the user's arm. The device gains mechanical advantage and thereby increase the effective weight applied without requiring actual increase in the number or size of the weight training plates used. The device includes a frame having a handgrip and a bar for mounting weights outward of the handgrip. First and second braces are situated toward a rearward end of the frame for engaging opposite sides of the user's forearm. One brace is situated between the handgrip and remaining brace to engage the forearm on one side surface. The remaining brace is situated near a rearward end of the frame to engage the user's forearm at a point rearward of the first brace and adjacent the elbow. The braces cooperate with the handgrip to maintain position of the weights at an extended location beyond the user's hand.

19 Claims, 4 Drawing Figures

FIG 1
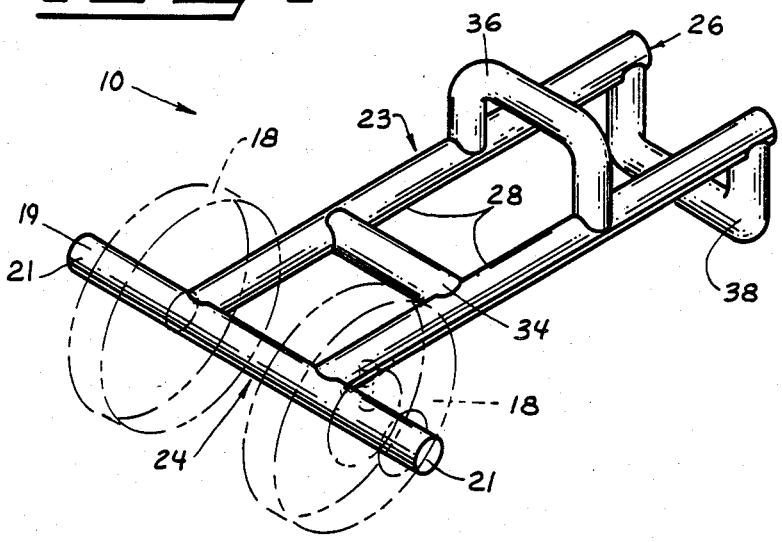
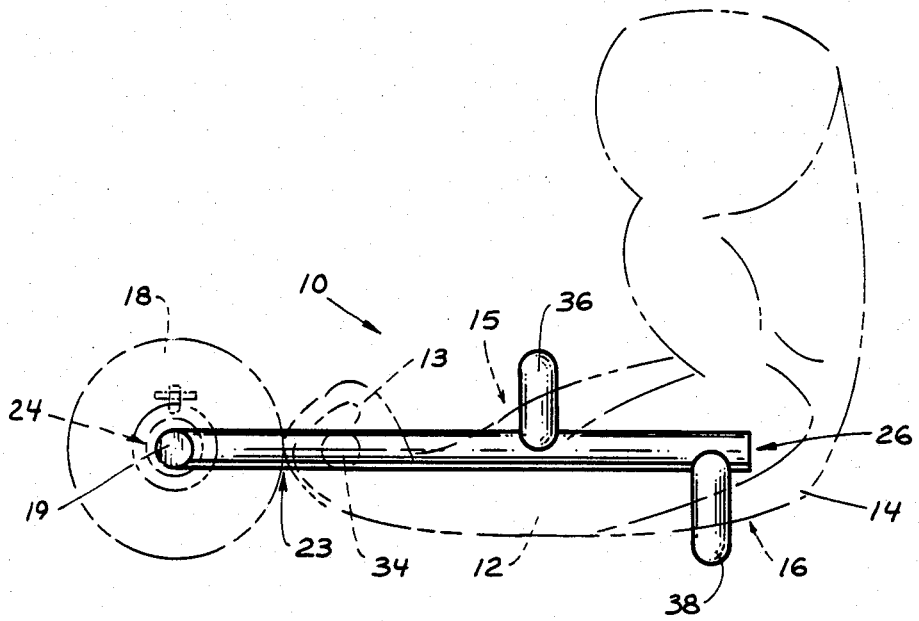
FIG 2

FIG 3
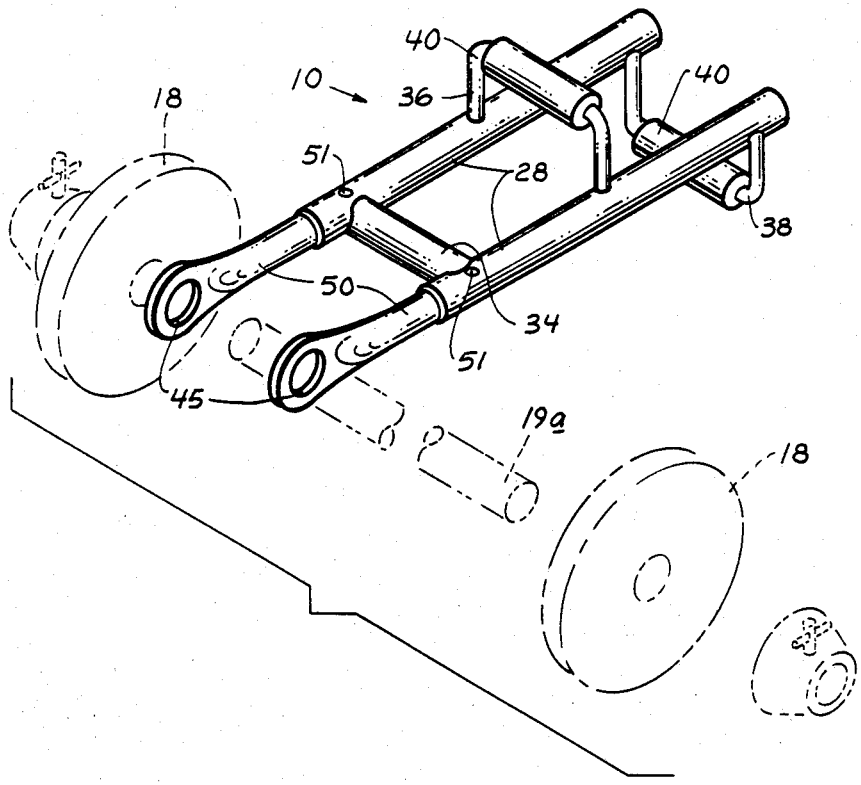
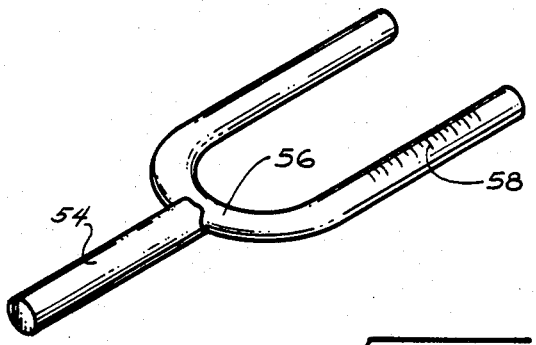
FIG 4

WEIGHT TRAINING DEVICE

FIELD OF THE INVENTION

The present invention relates generally to equipment using weights as selective resistance against lifting forces applied by the user.

BACKGROUND OF THE INVENTION

Weight training typically involves the use of barbells and dumbells. Both may consist of solid bars with opposite ends mounting removable weight training plates. The plates are supplied in sets with various weight increments of, for example 2.5 lbs. Thus, a dumbell weighing 25 lbs. (discounting the weight of the bar) might consist of two 10 lb. plates and two 2.5 lb. plates mounted at opposite ends of the bar. Additional plates must be added if the user wants to increase the amount of weight on the bar. Changing the weight to, say, 40 lbs. requires more or heavier plates. Two 2.5 lb. plates and two 5 lb. plates could be added to the existing plates to produce a total weight of 40 lbs. Alternatively, a total of four 10 lb. weights or eight 5 lb. plates could be used. This example is given merely to indicate the need for many weight training plates for even a single dumbell. Some routines require two dumbells of equal weight used simultaneously. Usually, the number of plates grows with the development of the user's muscles. Additional plates are thus continually being added to the original "set ".

Weight training plates are both expensive and cumbersome to store, due to their size and weight. It is therefore desirable to increase the capability of an existing weight set without substantially increasing the number of weight training plates required.

The amount of weight on a bar can be increased by extending the mass of the weight beyond the arms of the user. A typical example is the "swingbell". The swingbell consists of a bar having a set of weights mounted at one end. The free end of the bar is grasped at the other end. The mass of the weight thus extends outward from the user's arm. The relationship of weight and distance from the hand increases the leverage of the weight against the user's arms. The increase is a factor of the distance between the user's palm and the center of mass for the weights. A device similar to a swingbell is shown in U.S. Pat. No. 1,658,108.

Swingbells require sufficient strength at the wrist to support the cantilevered weight. The wrist muscles are normally substantially weaker than the upper arm muscles. Thus, "swingbells" are ineffective for training to develop muscle groups other than those in the wrist area.

U.S. Pat. No. 4,312,506 to Brennan discloses a bicep excerising curling bar that reduces wrist fatigue during curling operations. However, this apparatus functions to orient the mass of the weight on the dumbell or barbell inward, toward the user's body from the hands. The lever arm is therefore reduced. The overall effect of the weight training plates mounted to the bar is correspondingly reduced.

U.S. Pat. No. 4,231,569 to Rae discloses a device that is used to extend a standard bar or dumbell weight outwardly of the user's forearm to increase the leverage produced by the weight. This device includes a triangular framework having the weight, a handgrip, and a forearm brace at corners of the triangle configuration. The user's forearm will come into contact with the brace only through certain portions of arcuate movement of the user's arm. The weights swing freely through the remainder of arm motion with the forearm brace disengaged from the user's forearm. The effect with the weight hanging freely is no different than the effect experienced with ordinary dumbells.

The above cited patents are illustrative of apparatus used in conjunction with weight training plates for engagement of some sort with the user's forearm. The reason for forearm engagement by a pad in the Brennan patent is to eliminate strain at the user's wrist. Forearm engagement by the Rae device is intended to increase resistance of existing weights at specified angular orientations of the user's forearms to the upper arms. There is a continuing need, however, to obtain some form of exercise device that will effectively increase the distance between the weight and elbow and that will maintain the leverage produced thereby continuously during exercising. Such a device would reduce the need for continually adding plates to an existing set.

BRIEF DESCRIPTION OF THE DRAWINGS

The present invention is illustrated in the accompanying drawings in which:

FIG. 1 is a pictorial view of an exercising device embodying principle features of the present invention;

FIG. 2 is a side elevation view of the present device shown on a user's arm;

FIG. 3 is a pictorial view of another form of the present invention, and;

FIG. 4 is a view of an alternate weight training plate mounting bar.

DETAILED DESCRIPTION

The present invention is embodied in a exercising or weight training exercise device generally indicated at 10 in the accompanying drawings. FIG. 1 exemplifies one form of the invention while FIGS. 3 and 4 indicate alternate versions and components thereof.

The present device 10 is to be mounted on the forearm 12 and grasped by a hand 13. It is mounted between the elbow 14 and hand 13 as will be more fully explained below. Also, for purposes of later description, the forearm will be discussed as including a front or palmar surface 15 and a back or posterior surface 16.

The present device is also described in conjunction with weight training plates 18. Such plates 18 are of conventional configuration widely available. Such plates are provided in different sizes and weights to allow the user selective control of the weight being used on a bar for particular exercises.

The form of the present invention illustrated in FIGS. 1 and 2 includes a plate mounting bar 19 for releasably mounting selected weight training plates 18. The bar 19 extends between opposed ends 21 that are free to receive the weights. It is preferred that a equal amount of weight be placed at either end of the bar 19 to evenly distribute the weight applied through the present device to the user's arm.

The bar 19 of the FIGS. 1 and 2 form is rigidly affixed to an open frame 23. The frame 23 extends from a forward end 24, affixed to bar 19, to a rearward end 26. The forward frame end 24 is substantially centered between ends 21 of the bar 19. The frame 23 will abut weights applied to the bar 19 and function with appropriate conventional clamps or collars to hold the plates 18 in position.

The frame 23 is preferably formed of a pair of parallel frame members 28. The members 28 shown in FIGS. 1 and 2 are rigid. Members 28 may also be formed of interfitting telescoping members that can be slidably adjusted to vary the frame length as shown in FIGS. 3 and 4.

A handgrip 34 is provided on the frame 23 rearward of bar 19. Handgrip 34 may be parallel to the bar as sown in FIGS. 1 through 3. This relationship may vary as exemplified by the bar arrangement shown in FIG. 4 and which will be discussed in further detail below.

A first brace member 36 is provided along the frame 23 rearward of the handgrip 34. A second brace member 38 is provided rearward of first brace 36. The braces 36 and 38 are oriented to receive the user's forearm they engage opposite surfaces 15, 16 of the forearm when the device is in use.

The brace members 36 and 38 may be formed in "U" configurations, facing in opposite directions and extending to opposite sides of the frame 23. Their opposite ends may be connected to the frame bars 28, as are those of the handgrip 34 as shown. The handgrip may lie along a plane passing through the axis of bar 19. The brace members extend to opposite sides of this plane. The forearm is therefore received between the braces and along the plane as shown in FIG. 2.

The first brace 36 is positioned rearward of the handgrip 34 to engage the user's forearm between the elbow and wrist. The second brace 38 is provided to engage the user's forearm at a position closely adjacent the elbow. Both braces may be provided with resilient pads 40 for cushioning the device against the user's forearm.

The version of the present device illustrated in FIG. 3 includes eyelets apertured brackets 45 for slidably receiving an existing form of bar 19*a* used on conventional barbells or dumbells. The device provided in this form may be marketed to individuals having already complete weight training sets and that wish to adapt their bars or dumbell bars to the present device. Such bars can be used along with the typical weight training plates 18 and existing clamps or collar arrangements to secure the bars and weights to the present device 10. The eyelets or mounting brackets 45 thus function as means for securing a bar 19*a* to the frame 23.

FIG. 3 also illustrates a telescoping relationship along the parallel bars of the frame. With this arrangement, telescoping members 50 and complementary setscrews 51 can be used to selectively adjust the distance between the axis of a bar and the handgrip 34.

FIG. 4 is illustrative of a different form of bar 54 that will be readily received by the telescoping frame arrangement illustrated in FIG. 3. It is understood, however, that such a bar 54 could also be incorporated integrally with the frame as the bar 19 is with the version shown in FIGS. 1 and 2.

The bar 54 is carried on a yoke 56 having ends to be slidably received in the telescoping pocket members of the frame. The yoke orients the bar 54 along an axis that may be substantially perpendicular to the handgrip 34. Weights received on bar 54 can thus be adjusted along its length to effectively increase or decrease the leverage applied through the frame to the user's arms. Calibrations 58 can be provided along the yoke to indicate the yoke position in relation to the handgrip.

The present device can be used to effectively increase the resistance applied to the user's arms through any of a variety of exercise routines that have been typically performed in the past using dumbells or barbells. For example, the standard "curl" exercise is illustrated in FIG. 2. Here the user has inserted an arm between the braces 36 and 38 and has grasped the handgrip 34 with his palm facing upwardly.

The curl begins with the arms substantially relaxed at the side. The elbows are then bent to begin an upward motion of the forearms. The weight cantilevered outward of the user's palm will urge the second brace 38 against the posterior surface 16 of the arm directly adjacent the elbow. The brace 38 prevents the handgrip from pivoting in the user's hand and allowing the plates to swing freely in a hanging position. The frame may shift in the user's hand again when the weight has been shifted to a nearly upright orientation. This occurs as the weight moves "over center". The shifting weight may cause the handgrip to pivot slightly in the user's hand with the first brace 36 pivoting into contact with the palmar or front surface 15 of the arm. Brace 36 thus prevents the weight from shifting too far forward toward the user's body. The exercise is completed by lowering the forearm to its beginning extended and relaxed orientation. The same exercises may be completed with any form of the present device shown, or with any conceivable combination of the elements shown and described above.

The training plates 18 situated outwardly or the user's hand is increase the lever arm acting against the muscles being exercised. In a sense the device lengthens the user's forearms, shifting the application of weight from the palm of the hand outwardly. The result is increased leverage applied to the arm. The same weight used on a standard dumbell will therefore "feel" much heavier through use of the present device. The applied leverage of course will vary with the distance between the weight and user's elbow.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An exercise device for mounting weight training plates, comprising:

a plate mounting bar for receiving weight training plates;

an elongated open frame having a front end mounted to the plate mounting bar and extending from the plate mounting bar to a rearward end;

a handgrip on the frame spaced toward the rearward frame end from the plate mounting bar, a first brace member on the frame spaced toward the rearward frame end from the handgrip;

a second brace member on the frame spaced rearwardly from the first brace member;

wherein the brace members are spaced apart relative to one another, so a user's forearm can be accommodated along the frame with the hand gripping the handgrip, and the first and second brace members located adjacent opposite surfaces of the forearm such that the second brace member is situated along the forearm adjacent the elbow and the first brace member adjacent the forearm between the hangrip and second brace member and wherein the mounting bar and frame lie along a longitudinal plane that, when the device is mounted to a user's forearm, substantially passes lengthwise through the forearm.

2. The exercise device as claimed by claim 1 wherein the second brace member is integral with the frame.

3. The exercise device as claimed by claim 1 wherein the frame is comprised of parallel elongated frame members extending from the plate mounting bar and wherein the handgrip and the first and second brace members cross the frame between the parallel frame members.

4. The exercise device as claimed by claim 1 wherein the frame extends along a plane; wherein the first and second brace members project to opposite sides of the plane; and wherein the handgrip is located within the plane.

5. The exercise device as claimed by claim 4 wherein the plate mounting bar is also positioned within the plane.

6. The exercise device as claimed by claim 1 wherein the frame is formed of a pair of bars mounted to the plate mounting bar and extending to a side thereof, the bars being spaced apart along the length of the plate mounting bar.

7. The exercise device as claimed by claim 1 wherein the frame and handgrip are substantially centered along the length of the plate mounting bar.

8. A weight training device to be fitted over a user's forearm and grasped by the hand thereof and for mounting weight training plates outward of the hand to selectively increase the leverage applied by the weight training plates during various exercises, the device comprising:

a elongated frame having a forward end and a rearward end;

a handgrip on the frame between the ends thereof;

a first forearm brace on the frame rearward of the handgrip and disposed on the frame to engage the user's forearm at a location thereon between the wrist and elbow;

a second forearm brace on the frame rearward of the first forearm brace and disposed on the frame to engage the user's forearm at a location thereon adjacent the elbow and rearward of the location along the forearm engaged by the first forearm brace;

mounting bar means on the frame at the forward end thereof, forward of the handgrip, for receiving and mounting a weight training plate;

wherein the mounting bar means is comprised of an elongated bar extending forwardly from the forward frame end and substantially perpendicular to the handgrip.

9. The weight training device as claimed by claim 8 wherein the mounting bar and frame lie substantially within a common longitudinal plane that, when the device is mounted to a user's forearm, substantially passes lengthwise through the forearm.

10. The weight training device as claimed by claim 8 wherein the frame is comprised of elongated frame members mounted to the mounting bar means and spaced apart along the length thereof to receive the user's forearm therebetween;

wherein the handgrip, first forearm brace, and second forearm brace span the space between the elongated frame members; and wherein the elongated bar of the mounting bar means extends along an axis substantially centered between the elongated frame members.

11. The weight training device as claimed by claim 8 wherein the first and second forearm braces are rigidly mounted to the frame.

12. The weight training device as claimed by claim 8 wherein the handgrip is rigidly mounted to the frame.

13. The weight training device as claimed by claim 8 wherein the frame is extensible longitudinally to vary the distance between the handgrip and mounting bar means.

14. A weight training device to be fitted over a user's forearm and grasped by the hand thereof and for mounting a conventional exercise device such as a barbell or dumbell having a bar with removable weight training plates at opposite ends of the bar; said weight training device comprising:

an elongated frame extending from a forward end to a rearward end;

bar mounting means at the forward frame end for releasably mounting the bar of the exercise device with opposite ends thereof exposed to mount the weight training plates;

a handgrip on the frame rearward of the bar mounting means;

a first forearm brace on the frame rearward of the handgrip;

a second forearm brace on the frame rearward of the first forearm brace means;

wherein the first and second forearm braces are disposed on the frame to opposite sides thereof such that a user's forearm can be inserted between the braces, with the hand gripping the handgrip and the braces being situated on opposite sides of the forearm; and wherein the bar mounting means is oriented such that the bar and weight training plates will be mounted to the frame along a plane that, when the device is mounted to a user's forearm, substantially passes lengthwise through the forearm.

15. The weight training device as claimed by claim 14 wherein the frame is comprised of elongated frame members mounted to the bar mounting means and spaced apart along the length thereof to receive the user's forearm therebetween; and wherein the handgrip, first forearm brace, and second forearm brace span the space between the elongated frame members.

16. The weight training device as claimed by claim 14 wherein the second forearm brace is rigidly mounted to the frame at the rearward end thereof.

17. The weight training device as claimed by claim 14 wherein the first forearm brace is rigidly mounted to the frame.

18. The weight training device as claimed by claim 14 wherein the handgrip is rigidly mounted to the frame.

19. The weight training device as claimed by claim 14 wherein the frame is composed of telescoping members so that the frame may be extensible longitudinally between the bar mounting means and handgrip to selectively vary the distance between a weight training plate mounted to the bar mounting means and the handgrip.

* * * * *